United States Patent [19]

Takahashi et al.

[11] 4,240,616

[45] Dec. 23, 1980

[54] APPARATUS FOR HEAT-TREATING METALLIC MATERIAL

[75] Inventors: Nobuhiro Takahashi, Fukuyama; Ken-ichi Hirata, Okayama, both of Japan

[73] Assignee: Nippon Kokan Kabushiki Kaisha, Tokyo, Japan

[21] Appl. No.: 56,936

[22] Filed: Jul. 12, 1979

Related U.S. Application Data

[62] Division of Ser. No. 874,665, Feb. 2, 1978, Pat. No. 4,188,243.

[30] Foreign Application Priority Data

Feb. 8, 1977 [JP] Japan ..... 52-12064

[51] Int. Cl.[3] ..... C21D 9/00; C21D 9/08; C21D 1/42

[52] U.S. Cl. ..... 266/119; 266/128; 266/134

[58] Field of Search ..... 266/127–129, 266/113, 119, 258, 249, 134; 148/144, 145, 150, 153–156; 219/8.5, 10.67, 10.73; 432/87, 230, 243

[56] References Cited

U.S. PATENT DOCUMENTS

| | | | |
|---|---|---|---|
| 3,189,490 | 6/1965 | Scott | 148/153 |
| 3,193,270 | 7/1965 | Dewez, Jr. et al. | 266/258 |
| 3,644,695 | 2/1972 | Shuey, Jr. et al. | 219/8.5 |
| 3,731,033 | 5/1973 | Ory | 219/10.73 |
| 4,158,758 | 6/1979 | Kunioka et al. | 266/113 |

FOREIGN PATENT DOCUMENTS

| | | | |
|---|---|---|---|
| 2314077 | 10/1973 | Fed. Rep. of Germany | 148/155 |
| 432207 | 9/1975 | U.S.S.R. | 266/249 |

*Primary Examiner*—L. Dewayne Rutledge
*Assistant Examiner*—Peter K. Skiff
*Attorney, Agent, or Firm*—Haseltine and Lake

[57] ABSTRACT

In the heat treatment (quenching treatment, tempering treatment, etc.) of long metallic material, such as, large diameter steel pipe or the like, in order to stabilize the speed of travel of the material through a heat treating zone, i.e., a zone including a heating unit, such as, an induction heating coil or gas burning type heating furnace and a following cooling unit of the type utilizing either one or both of air blast and water cooling, the material is gripped by two cars which are arranged respectively at the entry and delivery ends of the zone and the cars are moved, while supporting the material by a plurality of free rotatable rollers, so as to move the material at a desired speed. In this case, one of the cars is driven and the other car applies a braking force, thus moving the material at the desired speed through the zone.

8 Claims, 17 Drawing Figures

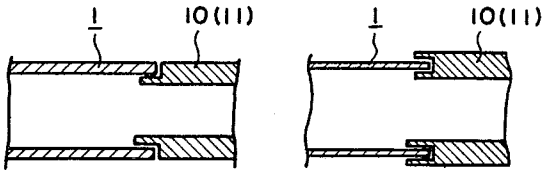
FIG. 13a
FIG. 13b
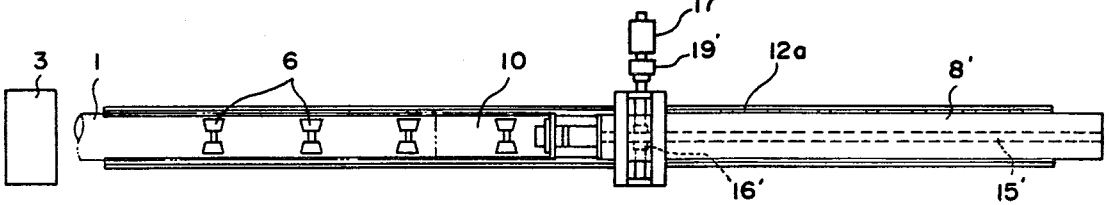
FIG. 14
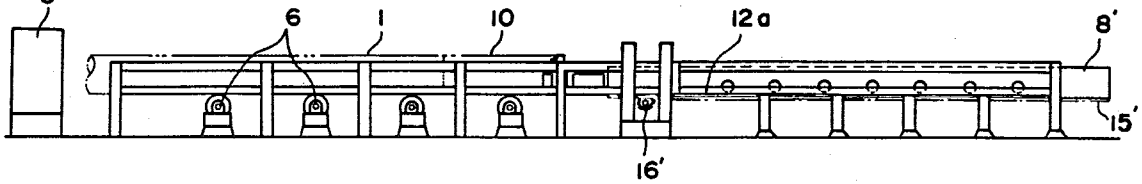
FIG. 15

APPARATUS FOR HEAT-TREATING METALLIC MATERIAL

This is a division of application Ser. No 874,655 filed Feb 2, 1978 U.S. Pat. No. 4,188,243.

BACKGROUND OF THE INVENTION

The present invention relates to methods and apparatus for heat treating metallic material, and more particularly the invention relates to a method and apparatus wherein a metallic material to be heat treated, e.g., a long material such as steel pipe, steel bar, shape steel, rail or the like is conveyed in its lengthwise direction at a stable speed, thereby preventing the occurrence of non-uniform heat treatment and ensuring improved heat treating efficiency.

In the past, where a long metallic material such as represented by large diameter steel pipe or the like is subjected to heating treatment over the entire length thereof by continuously conveying the material through a relatively short heating zone, it has been the usual practice to ensure that the material is fed at a constant speed as far as possible so as to prevent non-uniform heating of the parts of the material, that where the heating is effected by induction heating thus causing the ends of the material to tend to be underheated, preliminarily a dummy is joined to each end or excess length for cutting allowance is provided at each end so as to cut off the same after heat treatment, that straightener rolls are provided to remove any distortions produced in the material during the heat treatment, and so on.

In particular, where large diameter steel pipe or the like is heat treated with an induction heating coil, due to the fact that the length of the induction heating coil is extremely small as compared with the length of the metallic material to be heat treated, it is an essential requirement that the metallic material is moved through the coil at a constant speed at all times. In other words, if the travel speed of a metallic material through the coil differs for different positions of the material, this causes the heating time to differ for the different positions of the material with the result that even if the amount of heat supplied per unit time is made constant by the electric heating method. i.e., induction heating (even if the uniform heating of the metallic material in a plane normal to the directon of travel of the material is made easier), the metallic material cannot be heated uniformly in time and consequently the different parts of the material subjected to heating process will be heated to different temperatures, that is, the temperatures of these parts will not be uniform. Of course, this tendency becomes more marked with increase in the preset heating temperature of the coil.

If a metallic material to be subjected to heating treatment is exposed to different heating conditions locally (in the lengthwise direction), the following problems will be caused. In other words, firstly the mechanical properties of the heat treated material will not be the same throughout the material. Secondly, change of shape will be caused by the non-uniform heating. These phenomena will become more marked with increase in heating temperature and increase in the non-uniformity of heating due to the irregularity in the travel speed of the material, and these phenomena also become more marked with increase in the cooling rate for the cooling process following the heating process. As a result, where the material is heated to a relatively high temperature and then cooled rapidly as during a quenching treatment, these phenomena will be still more marked. Up to date, the following conveying methods have been used in connection with the heat treatment by induction heating of such metallic material as large diameter steel pipe.

(i) Roller conveyor method

In this method, metal material, e.g., steel pipe is placed on a roller conveyor and the material is conveyed by means of one or a plurality of drive rolls. While this method is suited for fast feeding purposes, where is a disadvantage that in the case of a treatment, e.g., heat treatment where the feeding speed is low (several tens to several hundreds milli per minute), it is difficult to maintain the feeding speed constant with the result that the conveying speed is made unstable due to slip between the material and the roll surface and consequently the heat treatment is effected non-uniformly.

(ii) Pinch roll method

In this method, metallic material such as steel pipe is conveyed while the material is being held between a pair of top and bottom pinch rolls or between the rolls of a plurality of such pinch roll units which are arranged at a spacing. While this method is advantageous over the first-mentioned method in that the feeding speed is maintained constant, in the case of a metallic material having a circular section, for example, even if the rotational speed of the pinch rolls is maintained constant, there is the difference between the peripheral speeds at the center and marginal portions of the rolls and a slip will be caused between the metallic material and the rolls at some circumferential points of the material. As a result, if the shape of the metallic material is changed even a bit, the contact points between the pinch rolls and the material will be changed, thus changing the feeding speed. On the other hand, where the material is moved by the pinch rolls consisting of straightening rolls, a long material is passed between at least one pair of caliber rolls to straighten the bends and at the same time the material is conveyed at a desired speed to the heating zone by the rotation of the straightening rolls. Thus, while the feeding speed can be made relatively constant as compared with the case where the material is conveyed by feeding rolls, if there is any weld bead on the material or the material has been deformed, when the material contacts with the caliber rolls at a different part thereof, the feeding speed of the rolls will be changed at and around that part, thus making the feeding speed unstable and thereby making it impossible to accomplish both the desired straightening and the stabilization of feeding speed simultaneously.

Where the material is conveyed by driving the material feeding rolls and/or the straightening rolls, it is necessary to make the driving of the large number of such rolls to conform with one another throughtout a wide range of conveying conditions. For instance, where the feeding speed of 100 to 600 mm/min is required for feeding the material in one direction for quenching treatment and then the material is fed in the opposite direction at the speed of 50 to 300 mm/min for tempering treatment, the roll speeds have a wide range of 1:12 (50 to 600 mm/min) with the result that a drive system and the associated units must be provided and the driving system becomes extensive and complicated. The driving system will be made more extensive, if the fast feeding necessary for increasing the efficiency of non-treating feeding and the reverse feeding of material is additionally required.

Further, since no material supporting rolls or the like are provided in the heating zone, with the conventional techniques the ends of the material bend downwardly while the material is introduced into and heated in the zone, and this constitutes a cause of non-uniform heating, bending or the like.

(iii) Car transport method

This method is one in which a single car with a drive mechanism is run on the rails so as to convey a metallic material fixedly mounted in places on the car, and this method also has a problem of friction between the rails and the wheels of the car, thus causing a slip and thereby making the feeding unstable.

These are the disadvantages of the material conveying methods known in the art.

On the other hand, while methods are known in the art which are designed to prevent the ends of material from being heated non-uniformly, such as, one in which a dummy is joined by welding or the like to each end of the material so as to cut off the same after the heat treatment, and another in which an excess length is provided at each material end so as to cut off the same after the heat treatment, these methods also have the disadvantage of requiring additional labor and expenses and deteriorating the yield. Where a metallic material is heat treated by the conventional technique without joining any dummy to each material end, when the ends of the material move past the cooling unit, the cooling water, particularly the cooling water on the inner surface of the pipe will be discharged from the material ends and scattered in all directions, thus producing deteriorating effects on the electric equipment, etc., and also deteriorating the working environment.

SUMMARY OF THE INVENTION

The present invention has been made to overcome the above-mentioned deficiencies in the prior art.

It is therefore a principal object of the present invention to convey a metallic material at a steady speed into a heating zone and thereby to stably subject the entire length of the material to heat treatment at the desired feeding speed.

It is another object of the invention to minimize the occurrence of non-uniform heat treatment of material.

It is still another object of the invention to eliminate the need to join a dummy or excess length to each material end and the need to cut off and remove the same after the heat treatment and thereby to ensure improved heat treating efficiency.

Thus, in accordance with the method of heat treating metallic material provided according to the invention, a material to be treated is gripped at its forward and rear ends by two cars which are respectively arranged at the entry and delivery ends of a heat treating zone comprising a heating unit and/or a cooling unit, whereby while supporting the material on a plurality of free rotatable rolls, one of the cars is driven and a braking force is applied by the other car, thus moving the material by the cars and subjecting it to heat treatment. In this case, preferably the material is pushed from behind by the driven car and a braking force is applied to the material by the forward braking car. Also a dummy is preliminarily attached to each of the cars and thus the dummies are pressed against the ends of the material, thereby eliminating the need to preliminarily join a dummy by welding or providing an excess length at each end of a material itself and to cut off and remove the same after the heat treatment.

The cars are supported on the rails by wheels to run over the rails by the turning of the wheels and the brakes which are separately mounted on the cars are directly pressed against the rails for braking. The cars should preferably be driven by pinion gears which engage with the rack gears disposed along the rails, and consequently a drive system including motors and pinion gears is mounted on each car. In another form of the invention, particularly where the distance of travel of the cars is short, the car may be provided with a rack gear which is adapted to engage with a pinion gear rotated by a motor serving as a stationary unit to thereby move the cars. This has the advantage of eliminating the provision of such installations as power cables, trolleys and the like which must be connected to the cars.

The above and other objects, features and advantages of the present invention will become readily apparent from the following description of the preferred embodiments.

BRIEF DESCRIPTION OF THE DRAWINGS

FIGS. 13*a* and 13*b* are partial sectional showing respectively the manner in which a dummy is fitted on a pipe to be treated.

FIG. 14 is a plan view of the entry equipment of a heat treating line incorporating the cars according to another embodiment of the present invention.

FIG. 15 is a side view of the equipment of FIG. 14.

DESCRIPTION OF THE PREFERRED EMBODIMENTS

Figure 1A:
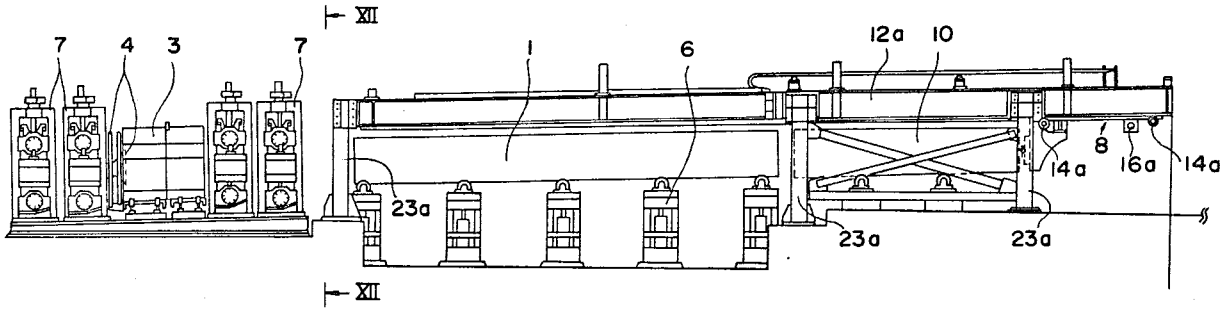
FIG. 1*a* is a side view of a heat treating line incorporating an embodiment of the present invention, showing the heating and cooling zone and its entry end equipment.
Figure 1B:
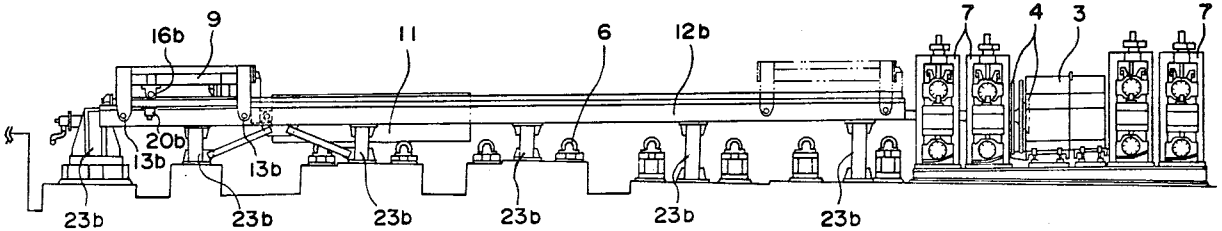
FIG. 1*b* is a side view similar to FIG. 1*a*, showing the heating and cooling zone and its delivery end equipment.
Figure 2:
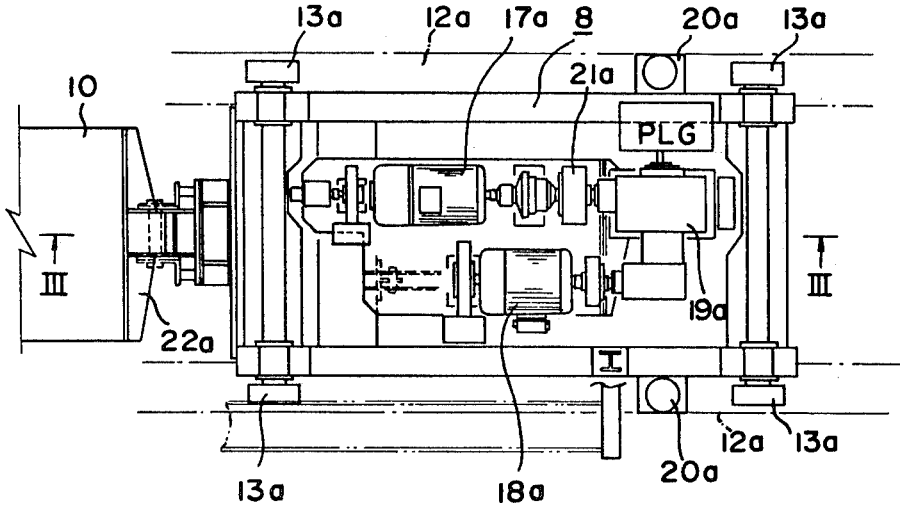
FIG. 2 is an enlarged plan view of the entry car 8 shown in FIG. 1.
Figure 3:
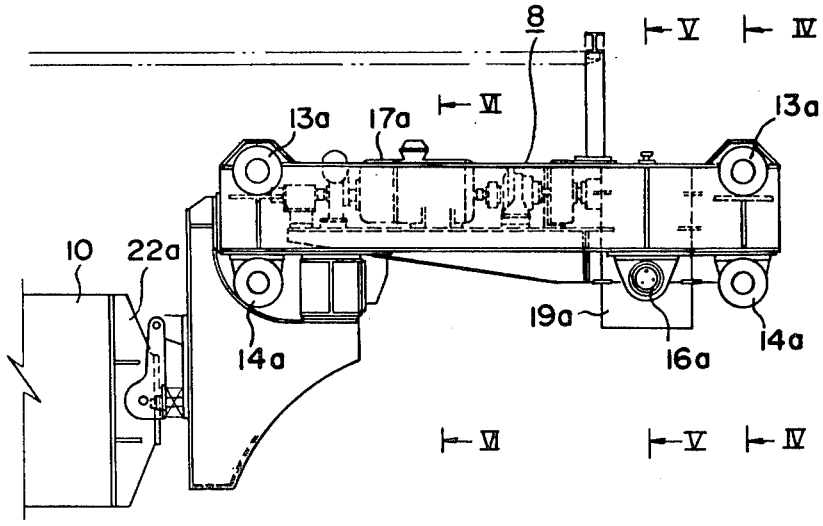
FIG. 3 is a sectional view taken along the line III—III of FIG. 2.
Figure 4:
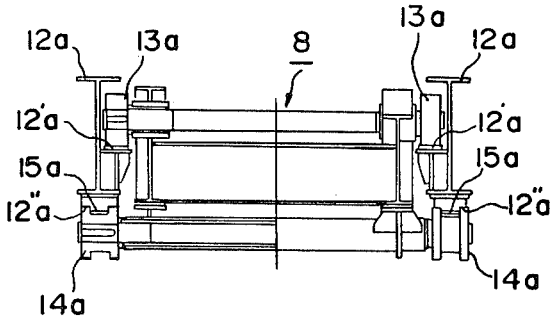
FIG. 4 is a sectional view taken along the line IV—IV of FIG. 3.
Figure 5:
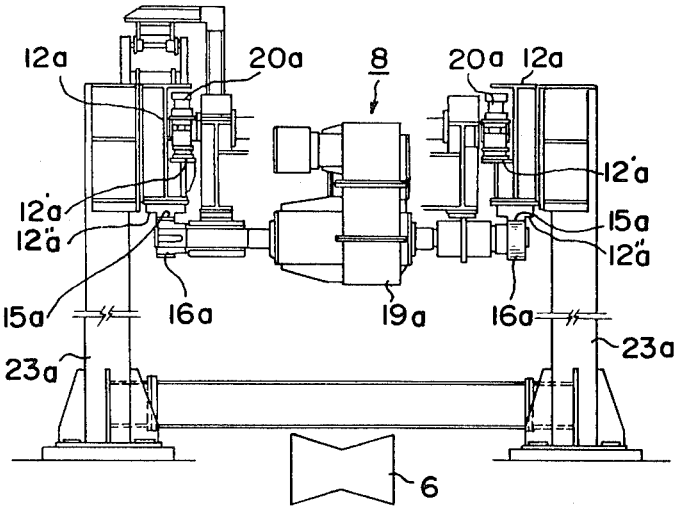
FIG. 5 is a sectional view taken along the line V—V of FIG. 3.
Figure 7:
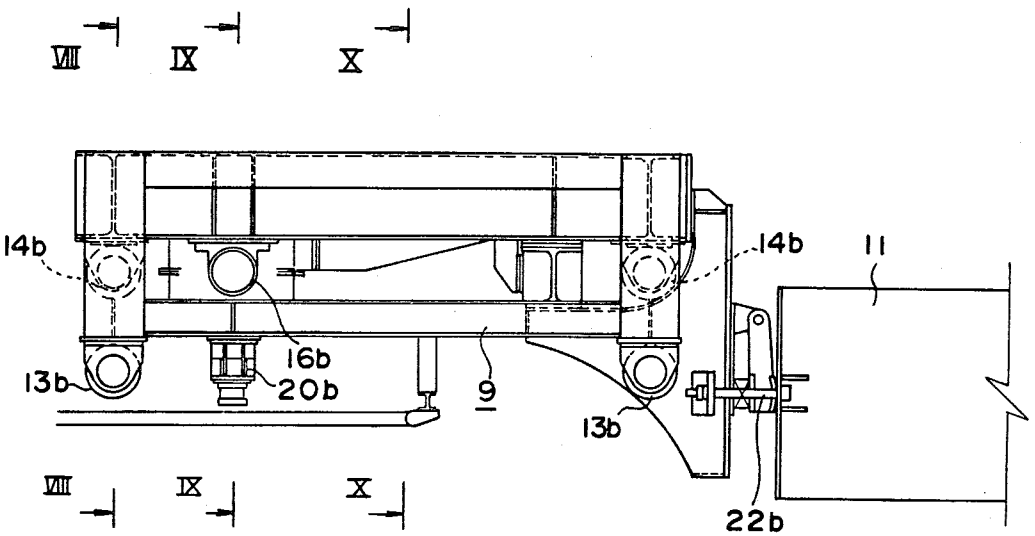
FIG. 7 is an enlarged side view of the delivery car 9 shown in FIG. 1.
Figure 6:
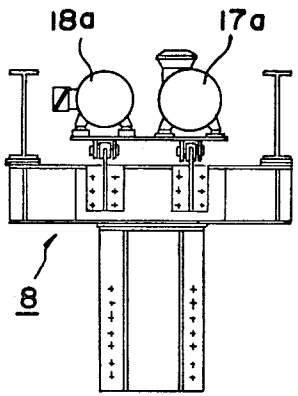
FIG. 6 is a sectional view taken along the line VI—VI of FIG. 3.
Figure 8:
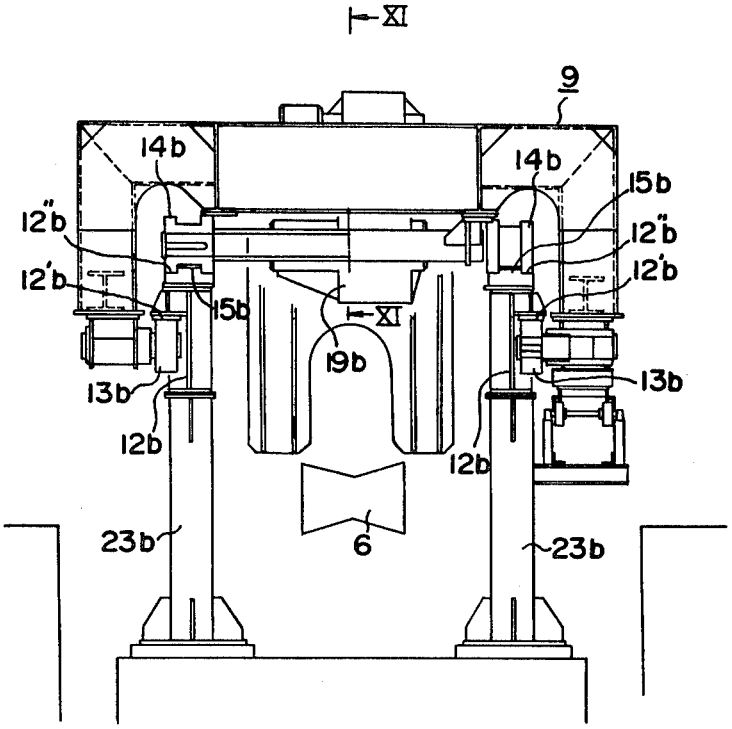
FIG. 8 is a sectional view taken along the line VIII—VIII of FIG. 7.
Figure 9:
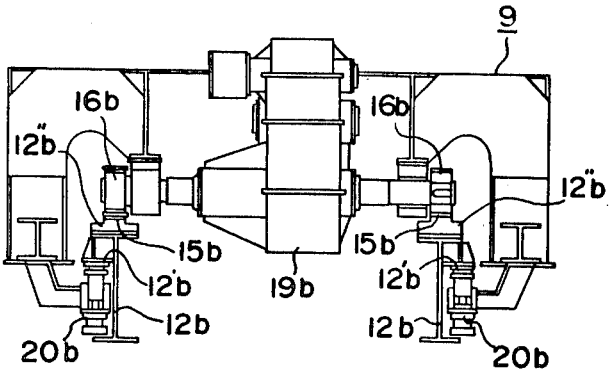
FIG. 9 is a sectional view taken along the line IX—IX of FIG. 7.
Figure 10:
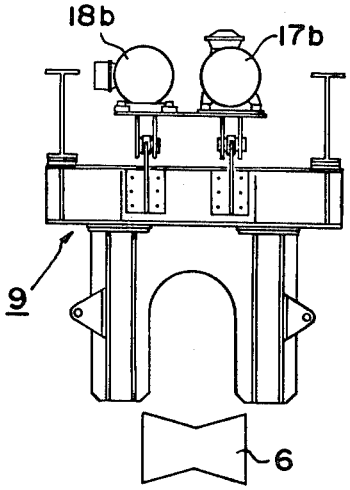
FIG. 10 is a sectional view taken along the line X—X of FIG. 7.
Figure 11:
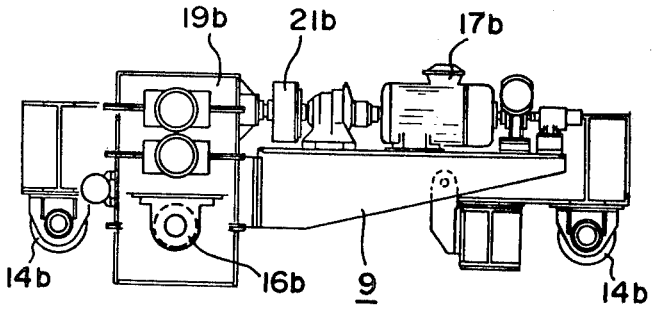
FIG. 11 is a sectional view taken along the line XI—XI of FIG. 8.

Referring first to FIGS. 1*a* and 1*b*, numeral 1 designates a long metallic material to be heat treated which is in the form of a large diameter steel pipe by way of example. Numeral 3 designates an induction heating coil which is disposed substantially in a horizontal position, and 4 a cooling unit which in this embodiment takes the form of one having two ring nozzles for cooling the material from inner and outer sides. The induction heating coil 3 and the cooling unit 4 constitute a heat treating zone, and it is needless to say that the cooling unit 4 is designed for use only in case of need and that there are cases where the cooling unit 4 is not used, although it is included in the line. In other words, when the material 1 is subjected to quenching treatment, coolant is sprayed from the nozzles of the cooling unit 4. In this case, if the material 1 is a tubular product which is to be subjected to internal quenching or double-side quenching, the spraying of the coolant is effected by reversely inserting the cooling nozzle into the tubular product from the direction of its movement and spraying the coolant against it. Consequently, the coolant must be discharged from the leading end of the tubular product and consequently the entire treating line is inclined to form a suitable slope with respect to the ground line as shown in FIGS. 1*a* and 1*b*. This has also been a cause of slipping phenomenon of tubular products encountered in the prior art methods. In view of this fact, with the prior art methods employing a mechanism which simply conveys a tubular product by means of the drive produced by the sticking force of the rolls contacting and supporting the product, there is a disadvantage that due to the treating line being inclined as mentioned previously, a slip will be caused between the product and the rolls supporting it, thus causing the feeding speed to become more non-uniform. In accordance with the conveying method of this invention, a material 1 is gripped from both the entry and delivery ends of a line by two cars one of which is driven by a non-slip car drive mechanism, such as, a rack and pinion mechanism, etc., and the material is conveyed at a desired speed while applying braking by the other car.

Figure 12:
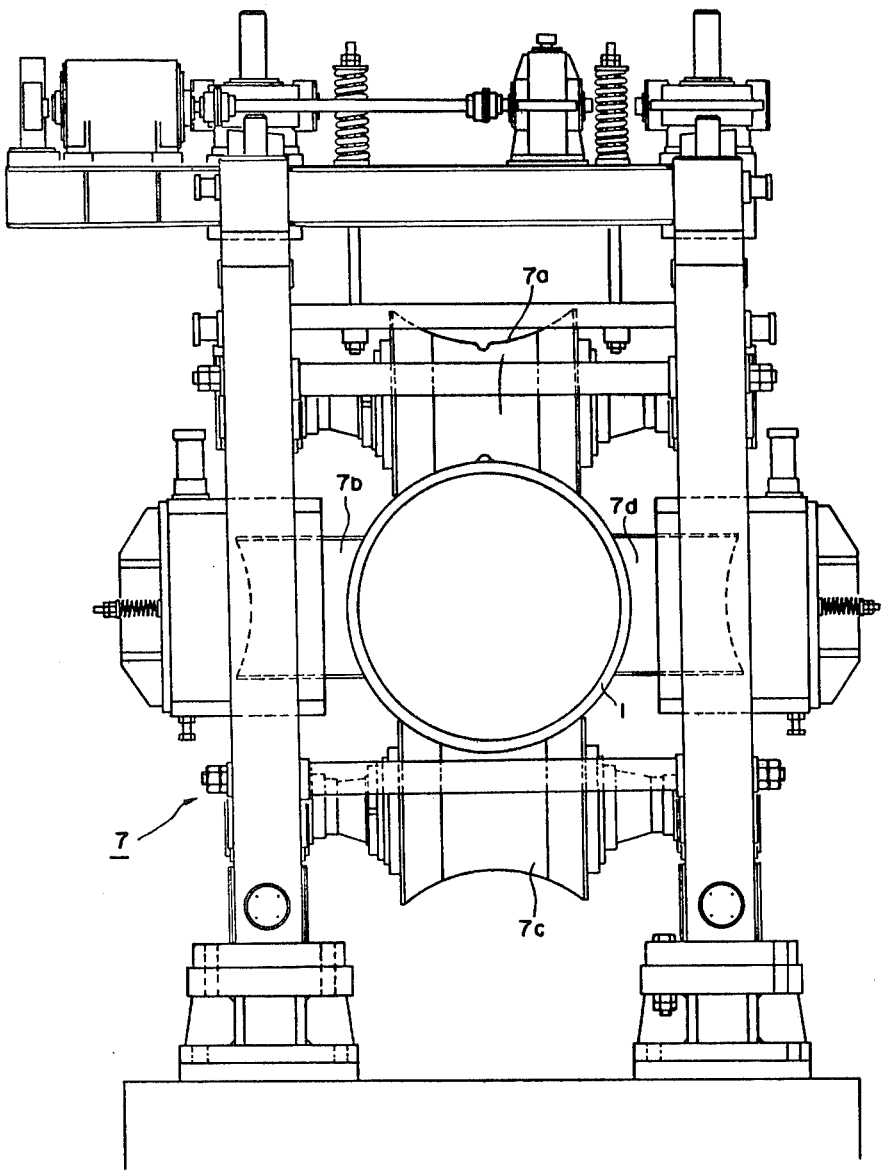
FIG. 12 is an enlarged elevation taken along the line XII—XII of FIG. 1.

Numeral 6 designates feeding roll units, and in accordance with the invention the rolls are driven only for conveying the material to its heat treatment starting position, for conveying the material after the completion of the heat treatment and for non-treating feeding, such as, for feeding the material through the heat treating zone during the periods other than the heat treating period, and the rolls are caused to idle during the periods of heat treatment. Numeral 7 designates straightening roll units whose rolls are used in a similar manner as those of the feeding roll units 6, namely, the rolls are solely used for the purpose of non-treating feeding and the rolls are caused to idle when the material is subjected to straightening during the heat treatment. Numerals 8 and 9 designate entry and delivery cars which are features of the invention, and in accordance with the invention when conveying the material 1 into the heat treating zone for heat treatment, as mentioned previously, the rolls of the feeding roll units 6 and the straightening roll units 7 are not driven to permit free rotation, and a rail mechanism (to be described later) is provided to extend straightly in each of the entry and delivery directions with the heat treating zone being located centrally. Thus, by driving rack gears by pinion gears provided on the car 8, the car 8 can be moved on the rail mechanism, and also the delivery car 9 is provided with an overrun preventing brakes for applying braking. In this way, the material 1 is gripped between the cars 8 and 9 to convey the material 1. Of course, the delivery car 9 is provided with pinion gears so that the car 9 is driven and the car 3 applies the brakes thereon when the material 1 is to be conveyed in the reverse direction. Numerals 10 and 11 designate dummy pipes attached respectively to the entry and delivery cars 8 and 9, and the dummy pipes may be advantageously constructed so as to be fitted on the ends of the material 1 as shown in FIG. 13*a* or 13*b*. As will be seen from FIG. 12, each of the straightening roll units 7 should preferably be constructed so that the material 1 can be restrained from all sides by means of its caliber rolls 7*a*, 7*b*, 7*c* and 7*d* and that the roll 7*a* is formed with a relatively large groove 70 as shown in the Figure so as to provide a draft for the caliber roll contacting the part of the material 1 having for example a weld bead projection produced during the tube making operation.

Now referring to FIGS. 2 to 11, the car drive systems and the cars 8 and 9 will be described in greater detail. In the Figures, numerals 12*a* and 12*b* designate respectively a pair of parallel girders extended straightly in the delivery and entry directions with the heat treating zone being located therebetween, and numerals 12*a*', 12*b*' and 12*a*'', 12*b*'' designate respectively a pair of guide rails fixedly mounted in position in parallel to the girders 12*a* and 12 *b*. The guide rails 12*a*', 12*b*' and 12*a*'', 12*b*'' are arranged on both sides of the heat treating zone to extend therealong over a distance corresponding to the required material conveying distance of the entry and delivery cars 8 and 9, that is, a distance sufficient to permit the cars 8 and 9 to completely move the material 1 through the centrally located heat treating zone in either the entry or delivery direction. The guide rails are provided to always prevent the cars from being caused to sway sideways when the cars are subjected to unexpected impact during the gripping and feeding operations of the material 1 by the cars 8 and 9. Numerals 13*a*, 13*b* and 14*a*, 14*b* designate respectively the guide wheels mounted on the cars 8 and 9 to rotate over the surface of the guide rails 12*a*', 12*b*' and 12*a*'', 12*b*'' so as to ensure smooth running of the cars. Numerals 15*a* and 15*b* designate rack gears provided as one form of the car drive mechanism and disposed to extend over the same distance as the previously mentioned guide rails, that is, the rack gears are fixedly installed to extend over a distance corresponding to the material conveying distance of the cars 8 and 9 in parallel therewith. In this case, the rack gears 15*a* are mounted on the central surface portions of the guide rails 12*a*'' to project therefrom and the rack gears 15*b* are also mounted on the central surface portions of the guide rails 12*b*'' to project therefrom. The guide wheels 14*a* and 14*b* are each provided with a circumferential groove formed by depressing the central portion of the outer surface to suit the height of the rack gears 15*a* and 15*b*. As a result, the guide wheels 14*a* and 14*b* are guided by the surfaces of the guide rails 12*a*'' and 12*b*'' and the opposed sides of the rack gears 15*a* and 15 *b* to prevent the rolling of the cars in motion. The other wheels 13*a* and 13*b* are placed on the girders to contact with the rails so as to hold the rails from the upper and lower sides in association with the wheels 14*a* and 14*b*, and consequently the vertical bouncing of the moving car can be prevented by the clamping of the rails by the wheels 13*a* and 14*a* or 13 *b* and 14*b*. Numerals 16*a* and 16*b* designate pinion gears which are respectively mounted on the cars 8 and 9 so as to engage with the rack gears 15*a* and 15 *b* and thereby to constitute unitary rack and pinion mechanisms and provide the required drive mechanisms for the cars 8 and 9.

The cars 8 and 9 also equipped with DC motors 17*a* and 17*b*, AC motors 18*a* and 18*b* and reduction gears 19*a* and 19*b* adapted to be respectively selectively connected to these DC and AC motors, and the pinion gears 16*a* and 16*b* are rotated by these motors through the reduction gears 19*a* and 19*b*, respectively. The cars 8 and 9 are further equipped with hydraulic brakes 20*a* and 20*b* whose shoes are adapted to be directly pressed against the rails 12*a*' and 12*b*', respectively, and the brakes preferably are alighned with the pinion gears 16*a* and 16*b*, respectively.

In FIGS. 2 to 11, numerals 21*a* and 21*b* designate electromagnetic clutch brakes respectively connected to the shafts of the DC motors 17*a* and 17*b* in normal service, and 22*a* and 22*b* dummy pipe mounting devices respectively disposed on the cars 8 and 9, and the dummy pipes described in connection with FIGS. 1*a*, 1*b*, 13*a* 13*b* are fixedly mounted to the lower portions of the mounting devices 22*a* and 22*b*. Numerals 23*a* and 23*b* designate supports for supporting the girders 12*a* and 12*b*, respectively. The car drive mechanisms are not intended to be limited to the previously mentioned rack and pinion mechanisms, and it is possible to use various other drives excepting the sticking drives by the rotation of wheels, such as, feed screw mechanism, sprocket drive, wire rope pull drive, etc. Also where the rack and pinion mechanism is used, it may be arranged in the manner reverse to that shown in FIGS. 2 to 11, namely, the rack gear may be mounted on the car so as to be driven by the rotation of the pinion gear fixedly mounted on the girders. For example, as shown in FIGS. 14 and 15 as an exemplary form of an entry equipment for the induction heating coil 3, a rack gear 15' may be mounted centrally on the lower surface of a car 8', and a pinion gear 16' which meshes with the rack gear 15' and a motor 17' and a reduction gear 19' for driving the pinion gear 16' may be fixedly mounted on the girders 12*a* by means of a base mount 24.

With the embodiment shown in FIGS. 1*a* and 1*b* and FIGS. 2 to 11, the quenching operation will be described with reference to a case in which the material 1 is conveyed through the heat treating zone from the entry end to the delivery end. With the material 1 gripped by the delivery and entry cars 9 and 8 through suitable means, such as, by fitting the material 1 into the associated ends of the dummy pipes 11 and 10 of the cars 9 and 8 in the manner shown in FIG. 13*a* or 13*b*, the brakes 20*b* of the delivery car 9 are applied to prevent overrunning and the entry car 8 is moved at a desired speed by the above-mentioned rack and pinion mechanism. In this way, with the feeding roll units 6 and the straightening roll units 7 idling, the material 1 is conveyed to the left in FIGS. 1*a* and 1*b* and this feeding is continued until the pipe end of the material 1 is moved past the heat treating zone, thus completing the quenching treatment through the induction heating coil 3 and the cooling unit 4. In this case, in the initial condition the dummy pipe 11 of the delivery car 9 is extending through the induction heating coil 3 thus causing its forward end to extend through the coil entry end, and when the material 1 is moved past the heat treating zone thus entering into the final condition the dummy pipe 10 of the entry car 8 extends through the induction heating coil 3 and the cooling unit 4 thus causing its forward end to extend through the delivery end of the cooling unit 4.

The operation of feeding the thusly quenched material 1 in the reverse direction from the delivery end to the entry end and subjecting to tempering treatment, takes place in the following manner. Contrary to the case with the previously mentioned quenching operation, the brakes 20*a* of the entry car 8 are applied to prevent overrunning and the delivery car 9 is moved at a desired speed by the car drive mechanism. With the rolls of the feeding roll units 6 and the straightening roll units 7 idling, the material 1 is conveyed to the right in FIGS. 1*a* and 1*b* and this is continued until the pipe end of the material 1 is moved past the heat treating zone, thus completing the tempering of the material 1 by the induction heating coil 3.

In accordance with the present invention, by virtue of the fact that the constant speed operation of the cars 8 and 9 is accomplished by the non-slip car drive mechanisms, such as, rack and pinion mechanisms, chain drives or winches, it is possible to reciprocate the cars 8 and 9 by simply changing the connections of the clutches and there is also no danger of overrunning by virtue of the fact that the material is conveyed with the brakes on one of the cars being applied. Further, with some caliber rolls of the straightening roll units 7 being provided with the centrally formed grooves 70, there is no danger of causing misalignment of the tubular product due to the contact between the weld bead projections on the outer surface of the material 1 and the caliber rolls and danger of causing non-uniform feeding speed. The straightening roll units 7 are provided so that when the material 1 is deformed in the longitudinal and radial directions under the effect of heating or heating and cooling, the material 1 is straightened under the idling condition. Further, since the material 1 is gripped and conveyed by the cars 8 and 9 for heat treatment and the rolls of the feeding roll units 6 and the straightening roll units 7 are solely driven for non-treating feeding purposes and since both the quenching and tempering treatments can be accomplished by moving the material both ways through the same line, in extreme cases it is only necessary that the entry car governs the speed for quenching, the delivery car governs the speed for tempering and the feeding roll units 6 and the straightening roll units 7 govern the speeds suitable for non-treating feeding and therefore it is necessary to provide only the equipment required for these purposes. Still further, where only the quenching treatment is required or where both the quenching and tempering treatments are accomplished by repeatedly feeding the material in one direction instead of feeding the material both ways, it is only necessary to provide one of the cars with a car drive mechanism and the other car with overrunning preventive brakes, thus ensuring in any way simplification of the required equipment. Moreover, by virtue of the fact that the cars 8 and 9 are provided with the dummy pieces 10 and 11 and the material 1 is gripped between the dummies for conveyance through the heat treating zone, it is possible to prevent non-uniform heating of the ends of the material 1 due to underheating and it is also possible to prevent bending down of the material ends. Still further, since the dummies 10 and 11 are pressed against the material 1, it is possible to restrain the inner cooling water of the material 1 (in the case of quenching treatment) from flowing to the outside and scattering. In this case, since the inner cooling water is introduced from a cantilever mandrel supported at the rear end of the delivery end equipment, it is of course necessary for the dummy 11 of the delivery car 9 to have a sectional shape so that it is clear of the mandrel and its support located in the direction of movement of the dummy 11.

What is claimed is:

1. Apparatus for conveying metallic material to be treated in a heat-treating zone comprising: a pair of entry guide rail means and a pair of delivery guide rail means respectively provided at the entry and delivery ends of a heat treating zone including a heating unit, each of said entry and delivery guide rail means being laid and supported by a girder and having a pair of upper and lower rail surfaces; an entry car having a plurality of wheels disposed on said entry guide rail means so as to clamp said rail means from the upper and lower sides thereof and rotate on the upper and lower rail surfaces; a drive mechanism for driving said entry car without any slip between said entry car and said entry guide rail means; a delivery car having a plurality of wheels disposed on said delivery guide rail means so as to clamp the same from the upper and lower sides thereof and rotate on the upper and lower rail surfaces thereof, said delivery car further having a plurality of brakes adapted to be directly pressed against said delivery guide rail means when said delivery car is moved by said entry car with said metallic material to be treated being gripped between said entry and delivery cars; and a plurality of free rotatable rolls for supporting said metallic material gripped between said cars.

2. Apparatus according to claim 1, wherein said drive mechanism comprises a rack and pinion mechanism.

3. Apparatus according to claim 2, wherein said drive mechanism comprises a pair of rack gears mounted on said entry guide rail means, a pair of pinion gears mounted on said entry car for engagement with said rack gears and a plurality of motors and a reduction gear mounted on said entry car for driving said pinion gears.

4. Apparatus according to claim 3, wherein each of said rack gear is provided centrally on the surface of said entry guide rail means to project therefrom whereby the sides of said rack gears provided supporting surfaces against sidewise rolling of said entry car, wherein each of said wheels of said entry car is formed in the central portion of the outer periphery thereof with a peripheral groove sufficient for receiving said rack gear whereby said supporting surfaces are held between the inner sides of said peripheral groove.

5. Apparatus according to claim 1, wherein each of said entry and delivery cars is provided with a dummy of a sufficient length so that the dummy on one of said cars extends beyond said heat treating zone toward the other of said cars at either one end of each feeding stroke closer to said heat treating zone.

6. Apparatus according to claim 1, wherein said entry car further includes another brakes similar to said brakes, and wherein another drive mechanism similar to said drive mechanism is provided for driving said delivery car, whereby said another brakes and said another drive mechanism are operated for moving said metallic material in reverse from said delivery end to said entry end.

7. Apparatus according to claim 1, wherein a plurality of straightening roll units are provided just before and after said heat treating zone, each of said straightening roll units including a pair of top and bottoms pinch rolls and a pair of left and right pinch rolls, at least one roll of said pinch rolls being formed with a peripheral groove in the central portion of the peripheral surface thereof.

8. Apparatus according to claim 1, wherein said heat treating zone further includes a cooling unit located at the delivery side of said heating unit.

* * * * *